US009182744B2

(12) United States Patent
Karapatis et al.

(10) Patent No.: US 9,182,744 B2
(45) Date of Patent: Nov. 10, 2015

(54) OPTIMISED STRIKING MECHANISM DISC-VIBRATION PLATE FOR A TIMEPIECE

(71) Applicant: Montres Breguet SA, L'Abbaye (CH)

(72) Inventors: Polychronis Nakis Karapatis, Premier (CH); Younes Kadmiri, Morre (FR); Davide Sarchi, Renens (CH)

(73) Assignee: Montres Breguet SA, L'Abbaye (CH)

( * ) Notice: Subject to any disclaimer, the term of this patent is extended or adjusted under 35 U.S.C. 154(b) by 0 days.

(21) Appl. No.: 14/538,945

(22) Filed: Nov. 12, 2014

(65) Prior Publication Data

US 2015/0160616 A1 Jun. 11, 2015

(30) Foreign Application Priority Data

Dec. 9, 2013 (EP) ..... 13196156

(51) Int. Cl.

| | |
|---|---|
| ***G04B 21/08*** | (2006.01) |
| ***G04B 23/02*** | (2006.01) |
| ***G04B 23/00*** | (2006.01) |
| ***G10F 1/06*** | (2006.01) |

(52) U.S. Cl.

CPC ..... *G04B 23/026* (2013.01); *G04B 21/08* (2013.01); *G04B 23/005* (2013.01); *G04B 23/028* (2013.01); *G10F 1/06* (2013.01)

(58) Field of Classification Search

CPC ..... G10F 1/06; G04B 21/08; G04B 47/025; G04B 23/005; G04B 23/026; G04B 23/028

USPC ..... 368/269–273

See application file for complete search history.

(56) References Cited

U.S. PATENT DOCUMENTS

| | | | | |
|---|---|---|---|---|
| 2,876,670 | A | | 3/1959 | Duncan |
| 2,956,466 | A | * | 10/1960 | Duncan ..... 84/97 |
| 2,961,911 | A | * | 11/1960 | Duncan ..... 84/97 |
| 2004/0231486 | A1 | | 11/2004 | Segan et al. |

FOREIGN PATENT DOCUMENTS

| | | | |
|---|---|---|---|
| CH | 8 631 | | 12/1894 |
| CH | 405 896 | | 1/1966 |
| CH | 704 670 | A2 | 9/2012 |
| FR | 1 173 343 | | 2/1959 |
| GB | 888 948 | | 2/1962 |
| WO | WO 2004/090863 | A2 | 10/2004 |

OTHER PUBLICATIONS

European Search Report issued Jul. 10, 2014 in European Application 13196156, filed on Dec. 9, 2013 ( with English Translation).

* cited by examiner

*Primary Examiner* — Vit W Miska

(74) *Attorney, Agent, or Firm* — Oblon, McClelland, Maier & Neustadt, L.L.P.

(57) ABSTRACT

A disc-vibration plate assembly for a musical or striking timepiece, including at least one disc rotating about an axis and provided with pins projecting substantially parallel to this axis, and arranged to cooperate with strips comprised in at least one vibration plate of this assembly, each pin including an actuation surface arranged to cooperate with a complementary receiving surface of a corresponding strip and the section of these strips of the vibration plate gradually increases from the shortest strip which is the highest pitched, to the longest strip which is the lowest pitched. The complementary receiving surface includes an end edge, which, at the end of actuation of the strip, is on the same radius as a complementary end edge comprised in the pin.

17 Claims, 1 Drawing Sheet

Fig. 1
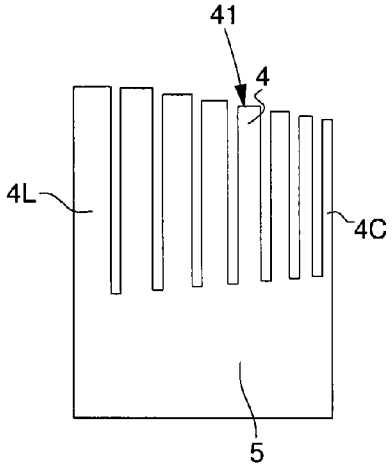
Fig. 5
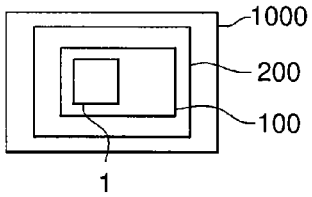
Fig. 2
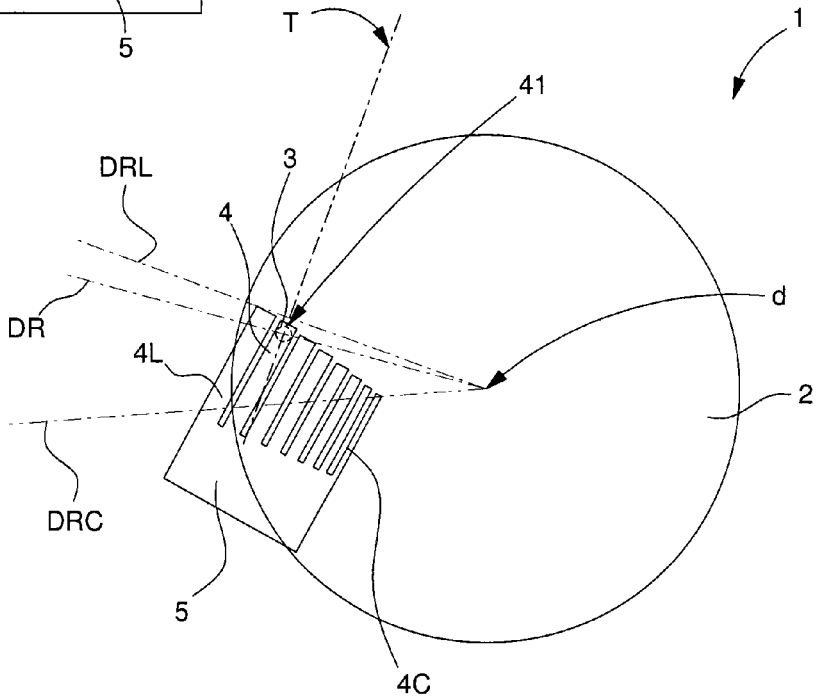
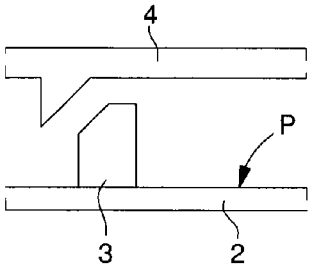
Fig. 3
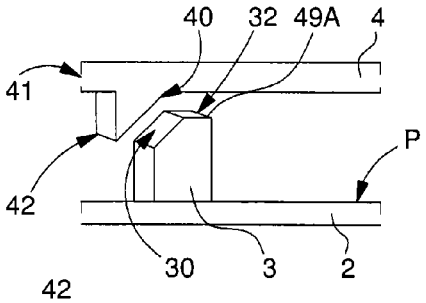
Fig. 4

OPTIMISED STRIKING MECHANISM DISC-VIBRATION PLATE FOR A TIMEPIECE

This application claims priority from European Patent Application No. 13196156.7 filed Sep. 12, 2013, the entire disclosure of which is incorporated herein by reference.

FIELD OF THE INVENTION

The invention concerns a disc-vibration plate assembly for a musical or striking timepiece, including at least one disc rotating about an axis and provided with pins projecting substantially parallel to said axis, and arranged to cooperate with strips comprised in at least one vibration plate of said assembly, each said pin including an actuation surface arranged to cooperate with a complementary receiving surface on a distal end of a said corresponding strip, and said distal end is placed on the same radius of said disc as said pin, wherein the section of said strips of said vibration plate gradually increases from the shortest strip which is the highest pitched to the longest strip which is the lowest pitched.

The invention also concerns a musical sound or striking mechanism including at least one such disc-vibration plate assembly.

The invention also concerns a timepiece movement including at least one such sound mechanism.

The invention also concerns a timepiece, in particular a watch, including at least one such movement, and/or at least one such mechanism.

The invention concerns the field of musical timepieces and music boxes and, more particularly, musical watches, striking and minute repeater watches, and alarms.

BACKGROUND OF THE INVENTION

The striking mechanism of musical watches is generally formed by a vibration plate and a system of actuating the vibration plate strips. The actuation system may be a rotating cylinder, as in most music boxes, or a rotating disc.

This latter solution, with a rotating disc disposed in the plane of the watch, is particularly advantageously because of its limited overall height, but it greatly limits the actuation energy of the strips producing the lowest notes. The melody is consequently not very audible.

Through pins are arranged on the striking disc so as to quickly lift and release each strip of the vibration plate. Two criteria are generally followed for the sizing of the disc-vibration plate system.

- all the strips have the same lifting travel, regardless of their length;
- the strips are released abruptly to avoid overdamping the bending and the occurrence of noise.

Despite the antiquity of musical timepieces, no guidance exists in the state of the art as regards:

- adaptation of the position of the vibration plate strips relative to the striking disc;
- the width of the strips and of the actuation pins;
- the height of the vibration plate strips;
- the height of the actuation pins:
- any adaptation between the shape of the inclined plane for lifting the strip by contact with the pin, the shape of the pins and the direction of movement of the pins (which, in a rotating disc, describe a circular orbit).

Consequently, the consumption of torque and thus the mechanical energy of the striking mechanism is generally not optimised:

- the take-up of torque is very different for the actuation of high and low notes and may be excessive for actuation of the shortest vibration plate strips, corresponding to the highest pitched notes;
- a significant part of the energy may be consumed by producing an improper deformation of the vibration plate strips, particularly a deformation having a torsion or bending contribution in the plane of the watch: as these deformations are overdamped and have an incorrect frequency contribution (dissonance), they result in a net loss of acoustic performance.

Since the loss of energy is proportional to the force and to the torque applied according to the degrees of freedom of these incorrect deformations, and since it depends on the result of multiplication of the spatial deformation generated and the mechanical stress created in the material, this loss of energy may be very significant even if the strips are made rigid so as to greatly reduce improper spatial deformations, since the mechanical stresses then increase.

US Patent Application No 2876670A in the name of DUNCAN discloses a music box disc-vibration plate assembly with strips of constant thickness and of unequal length and width, all within the projection of the disc onto the median plane of the vibration plate plate, which includes, in the solid part thereof on the side of the attachment of the strips, grooves forming resonant cavities.

CH Patent Application No 704670A in the name of BREGUET discloses a disc-vibration plate assembly for a music box with strips all within the projection of the disc onto the median plane of the vibration plate plate, and wherein the height of the control pins of the disc is adapted according to the torque to be transmitted.

CH Patent Application No 405896A in the name of FERNAND discloses a music box vibration plate partially encapsulated in a coating determining the free length of the various strips of which it is formed.

WO Patent Application No 2004/090863 A2 in the name of SEGAN LTD discloses an electronic music generating device, with a memory, magnetic sound generator and a vibration plate.

SUMMARY OF THE INVENTION

The invention proposes to optimise a striking vibration plate-disc system for overcoming these drawbacks of the state of the art.

To reduce the chronic energy losses of the prior art, it is an object of the present invention to maximise the energy in the first bending mode of each strip of the vibration plate, while optimising the direction and type of force produced when the strips are actuated, without however increasing the rigidity of the strips for unwanted degrees of freedom: torsion and bending in the plane of the timepiece or of the music box.

To this end, the invention concerns a disc-vibration plate assembly for a musical or striking timepiece, including at least one disc rotating about an axis and provided with pins projecting substantially parallel to said axis, and arranged to cooperate with strips comprised in at least one vibration plate of said assembly, each said pin including an actuation surface arranged to cooperate with a complementary receiving surface on a distal end of a said corresponding strip and said distal end is placed on the same radius of said disc as said pin, wherein the section of said strips of said vibration plate gradually increases from the shortest strip which is the highest pitched, to the longest strip which is the lowest pitched, characterized in that said complementary receiving surface includes an end edge, which is placed, at the end of said strip actuation phase, on the same radius relative to said pivot axis as a complementary end edge comprised in said pin, and in that said end edge and said complementary end edge are straight line segments.

According to a feature of the invention, said straight line segments are inclined relative to a plane perpendicular to said axis.

The invention also concerns a musical sound or striking mechanism including at least one such disc-vibration plate assembly.

The invention also concerns a timepiece movement including at least one such sound mechanism.

The invention also concerns a timepiece, in particular a watch, including at least one such movement, and/or at least one such mechanism.

BRIEF DESCRIPTION OF THE DRAWINGS

Other features and advantages of the invention will appear upon reading the following detailed description, with reference to the annexed drawings, in which:

FIG. 1 shows a schematic, plan view of a vibration plate for a musical watch according to the invention, wherein the width of the strips increases from the shortest strip to the longest.

FIG. 2 shows, in a similar manner to FIG. 1, the vibration plate of FIG. 1 superposed with the striking or melody disc with which it cooperates, wherein the longest strips of the vibration plate are partly arranged on the exterior of the striking disc.

FIG. 3 shows a schematic, cross-section view, along a plane parallel to the axis of rotation of the disc, and orthogonal to the radial line originating from the centre of the disc, the plane passing through a direction T, and passing through a given pin-strip pair, of a detail of the cooperation of the inclined planes of a pin and of a vibrating strip of a conventional disc-vibration plate assembly.

FIG. 4 shows, in a similar manner to FIG. 3, a disc-vibration plate assembly according to the invention, with orientation of the inclined plane of the strip and of the inclined plane of the pin in the radial direction of the disc to the strip-pin point of contact.

FIG. 5 shows a block diagram of a musical or striking watch including a disc-vibration plate assembly according to the invention.

DETAILED DESCRIPTION OF PREFERRED EMBODIMENTS

The arrangement and the mechanical and geometrical properties of the vibration plate strips and of the striking disc pins are adapted to each other to optimise actuation of each vibration plate strip, ensuring optimum exploitation of mechanical energy and minimising the take-up of torque necessary for generating sound.

The invention concerns a disc-vibration plate assembly 1 for a musical or striking timepiece 1000, including at least one disc 2 rotating about an axis D and provided with pins 3 projecting substantially parallel to said axis D, and arranged to cooperate with strips 4 of at least one vibration plate 5.

Each pin 3 includes an actuation surface 30, preferably formed by an inclined plane or similar, which is arranged to cooperate with a complementary receiving surface 40 on a distal end 41 of a corresponding strip 4 and said distal end 41 is placed on the same radius of disc 2 as said pin 3, said complementary receiving surface 40 being preferably also an inclined plane or similar.

Actuation is a phase during which the actuation surface 30 pushes complementary receiving surface 40 to tense the strip by moving it away from its rest position and providing it with potential energy. The end of actuation occurs after the complete tensing of strip 4 by the corresponding pin 3, and just before the pin and strip separate to let strip 4 resonate, strip 4 then returning the potential energy, in the form of sound energy, which was provided thereto by pin 3 during the rotational motion of disc 2.

Advantageously, the section of strips 4 of vibration plate 5 gradually increases from the shortest strip 4C which is the highest pitched, to the longest strip 4L which is the lowest pitched. Gradually increases means here increasing, or increasing in steps with identical sections between neighbouring strips of different length. In a particular variant of the invention, the increase is strict from one strip to another. Advantageously, the complementary receiving surface 40 includes an end edge 42 which is placed, at the end of the actuation phase of strip 4, on the same radius with respect to pivot axis D, as a complementary end edge 32 comprised in pin 3.

More specifically, the width of strips 4 of vibration plate 5 gradually increases from the shortest strip 4C (the highest pitched) to the longest strip 4L (the lowest pitched), as seen in FIG. 1. Gradually increases means here increasing, or increasing in steps with identical widths between neighbouring strips of different length. In a particular variant of the invention, the increase is strict from one strip to another.

Advantageously, the width of actuation pins 3 also gradually increases, in line with the width of strips 4 with which the pins 3 concerned cooperate. The width of a pin 3 is its useful dimension in the radial direction relative to axis D of disc 2, i.e. the dimension of the part of the pin intended to cooperate with the corresponding strip 4. In a particular embodiment seen in FIG. 4, pin 3 is of the trapezoid type.

Identical strip heights for the whole of the vibration plate permit more economical production, when the vibration plate is in one piece.

One possible variant consists in acting on the height of strips 4 and having, as an alternative to increasing strip width, increasing strip height, or, more simply, an increasing section of the strips from the highest pitched to the lowest pitched. In a particular embodiment, the height of strips 4 gradually increases from the shortest strip 4C which is the highest pitched, to the longest strip 4L which is the lowest pitched. However, the actuation energy is then greater if the strip has a constant section, which makes the use of the embodiment of the Figures preferable wherein the strips have a constant height and a variable width.

In a particular embodiment according to the invention, the end edge 42 and the complementary end edge 32 are straight line segments 49, 49A.

More specifically, these straight line segments 49, 49A are oblique, i.e. inclined with respect to a plane P perpendicular to the axis of rotation D of the disc.

In a particular embodiment, the width of the complementary end edges 32 comprised in actuation pins 3 also gradually increases in the same proportion as the section of strips 4 with which pins 3 respectively cooperate.

Advantageously, as seen in FIG. 2, some of longest strips 4 of vibration plate 5 are, at least partly, preferably over more one third of their length, arranged on the exterior of striking disc 2: this property makes it possible to minimise the take-up of torque, and thus extends the power reserve of the striking mechanism or musical mechanism, and makes the take-up of torque uniform during chiming or during performance of a melody.

Compared to a conventional configuration of actuation surfaces 30 of pins 2 and of complementary receiving surfaces 40 of strips 4, which are both oriented orthogonally to the main direction of the strips, the invention proposes a configuration making it possible to consume less torque: actuation surfaces 30 of pins 3, and complementary receiving surfaces 40 of strips 4 are oriented in a suitable manner, in the radial direction DR originating from the centre of disc 2 and passing through the strip-pin contact point, as seen in FIGS. 2 and 4, so as to correct the angle formed by the strip 4 concerned with the local radial direction DR to prevent any waste of energy when strip 4 is lifted by its pin 3 and to maximise the energy stored in the first bending mode of the strip.

The line of contact between pin 3 and strip 4 must therefore preferably be in the radial direction to the disc at the moment the strip is released, thus at the end of actuation.

FIG. 4 shows the two ends of the cooperating surfaces, line 32 on pin 3 and line 42 on strip 4. Of course, strict radial alignment is an optimum condition, which cannot always be fulfilled because of the insertion of the other components of the musical or striking timepiece 1000, especially in the case of a watch where the striking mechanism is connected to complications which occupy a large volume. A maximum angular deviation of preferably 5° can be tolerated relative to this radial line.

FIG. 2 shows two radial lines DRC and DRL respectively corresponding to the shortest strip 4C and the longest strip 4L of vibration plate 5. Since the slope (in a preferred embodiment illustrated wherein surfaces 30 and 40 are inclined planes) is oriented tangentially to the trajectory T of pins 3 fixed to disc 2, each strip 4 is raised orthogonally to plane P of vibration plate 2, thereby preventing torsion and bending in the plane of the watch.

Pins 3 of striking disc 2 preferably have a height, relative to plane P of disc 2, which gradually increases from the shortest strip to the longest strip, which requires a gradually increasing lift.

The actuation energy of each strip is given by:

$$U = \frac{Ebh^3\delta^2}{8L^3} \tag{1}$$

where E is the Young's modulus, b the width, h the height, L the length of the strip and δ the lift of the strip.

According to the invention, the ratio of the actuation energy of the lowest pitched strip to that of the highest pitched strip must be greater than 1:3 (which corresponds to a difference in acoustic level of less than 5 dB).

This criterion requires a strict relation between the width of the strips, their lift and their length, in a particular embodiment wherein the height of the strips is advantageously identical for all the strips. If we consider the lowest pitched strip 4L (the longest) ($b_g$; Lg; $\delta_g$), and the highest pitched strip 4C la (the shortest) ($b_a$; La; $\delta_a$), the relation is:

$$\frac{b_g\delta_g^2}{L_g^3} \geq \frac{b_a\delta_a^2}{3L_a^3} \tag{2}$$

Specifically, for strips 4 of the same height and the same width, and each of the given frequency and lift characteristics (f; δ), the relation between the lowest pitched strip 4L ($f_g$; $\delta_g$, and the highest pitched strip 4C ($f_a$; $\delta_a$), satisfies the inequality $$\frac{\delta_g}{\delta_a} \geq \frac{2}{3}\left(\frac{f_a}{f_g}\right)^{3/4}. \tag{3}$$

In a particular embodiment, actuation surfaces 30 of pins 3, and the complementary receiving surfaces 40 of strips 4 are oblique planes relative to the plane P of disc 2 in a local radial direction DR originating from the centre of disc 2 and passing through the point of contact between the strip 4 and pin 3 concerned.

More specifically, with respect to axis D, a first radial line DRC corresponding to the strip 4 which is the shortest 4C, and a second radial line DRL corresponding to the strip 4 which is the longest 4L of vibration plate 5, form a non zero central angle with each other.

The invention also concerns a musical sound or striking mechanism 100, including at least one disc-vibration plate assembly 1.

The invention also concerns a timepiece movement 200 including at least one such sound mechanism 100.

The invention also concerns a timepiece 1000, particularly a watch, including at least one such movement 200, and/or at least one such mechanism 100.

The invention has numerous advantages:

- an improvement in the acoustic level of the sound radiated by a watch in the frequency band between 1 kHz and 4 kHz;
- increased uniformity of the acoustic level perceived during the melody;
- an improvement in the tuning and purity of the melody;
- increased power reserve of the striking mechanism.

What is claimed is:

1. A disc-vibration plate assembly for a musical or striking timepiece, including at least one disc rotating about an axis and provided with pins projecting substantially parallel to said axis, and arranged to cooperate with strips comprised in at least one vibration plate of said assembly, each said pin including an actuation surface arranged to cooperate with a complementary receiving surface on a distal end of a said corresponding strip and said distal end is placed on the same radius of said disc as said pin, wherein the section of said strips of said vibration plate gradually increases from said shortest strip which is the highest pitched, to said longest strip which is the lowest pitched, wherein said complementary receiving surface includes an end edge, which is placed, at the end of an actuation phase of said strip, on the same radius relative to said pivot axis as a complementary end edge comprised in said pin, and wherein said end edge and said complementary end edge are line segments, wherein said actuation surfaces of said pins, and said complementary receiving surfaces of said strips, are oblique planes relative to the plane of said disc, in a local radial direction originating from the centre of said disc and passing through the point of contact between said strip and said pin concerned.

2. The disc-vibration plate assembly according to claim 1, wherein said line segments are inclined relative to a plane (P) perpendicular to said axis.

3. The disc-vibration plate assembly according to claim 1, wherein the width of said strips of said vibration plate gradually increases from said shortest strip which is the highest pitched, to said longest strip which is the lowest pitched.

4. The disc-vibration plate assembly according to claim 1, wherein the width of said complementary end edges comprised in said actuation pins gradually increases in the same proportion as the section of said strips with which said pins cooperate.

5. The disc-vibration plate assembly according to claim 1, wherein said vibration plate includes several said strips amongst the longest of said vibration plate which are, at least partly over more than a third of the length thereof, arranged on the exterior of said disc.

6. The disc-vibration plate assembly according to claim 1, wherein said pins of said striking disc have a height, relative to the plane of said disc, which gradually increases in line with the section of said strips with which said pins cooperate, from said shortest strip to said longest strip.

7. The disc-vibration plate assembly according to claim 1, wherein, for said strips of the same height, and each of the given width, length and lift characteristics, the relation between said lowest pitched and longest, and said highest pitched and shortest strip, satisfies the inequality $$\frac{b_g\delta_g^2}{L_g^3} \geq \frac{b_a\delta_a^2}{3L_a^3}.$$

8. The disc-vibration plate assembly according to claim 1, wherein, relative to said axis, a first radial line corresponding to said strip which is the shortest, and a second radial line corresponding to said strip which is the longest of said vibration plate, form a non-zero central angle with each other.

9. A musical sound or striking mechanism including at least one said disc-vibration plate assembly according to claim 1.

10. A timepiece movement including at least one sound mechanism according to claim 9.

11. A timepiece, including at least one said movement according to claim 10.

12. The "timepiece" according to claim 11, wherein the timepiece is a watch.

13. A timepiece, including at least one said mechanism according to claim 9.

14. The "timepiece" according to claim 13, wherein the timepiece is a watch.

15. A disc-vibration plate assembly for a musical or striking timepiece, including at least one disc rotating about an axis and provided with pins projecting substantially parallel to said axis, and arranged to cooperate with strips comprised in at least one vibration plate of said assembly, each said pin including an actuation surface arranged to cooperate with a complementary receiving surface on a distal end of a said corresponding strip and said distal end is placed on the same radius of said disc as said pin, wherein the section of said strips of said vibration plate gradually increases from said shortest strip which is the highest pitched, to said longest strip which is the lowest pitched, wherein said complementary receiving surface includes an end edge, which is placed, at the end of an actuation phase of said strip, on the same radius relative to said pivot axis as a complementary end edge comprised in said pin, and wherein said end edge and said complementary end edge are line segments, wherein said vibration plate includes several said strips amongst the longest of said vibration plate which are, at least partly over more than a third of the length thereof, arranged on the exterior of said disc.

16. A disc-vibration plate assembly for a musical or striking timepiece, including at least one disc rotating about an axis and provided with pins projecting substantially parallel to said axis, and arranged to cooperate with strips comprised in at least one vibration plate of said assembly, each said pin including an actuation surface arranged to cooperate with a complementary receiving surface on a distal end of a said corresponding strip and said distal end is placed on the same radius of said disc as said pin, wherein the section of said strips of said vibration plate gradually increases from said shortest strip which is the highest pitched, to said longest strip which is the lowest pitched, wherein said complementary receiving surface includes an end edge, which is placed, at the end of an actuation phase of said strip, on the same radius relative to said pivot axis as a complementary end edge comprised in said pin, and wherein said end edge and said complementary end edge are line segments, wherein said pins of said striking disc have a height, relative to the plane of said disc, which gradually increases in line with the section of said strips with which said pins cooperate, from said shortest strip to said longest strip.

17. A disc-vibration plate assembly for a musical or striking timepiece, including at least one disc rotating about an axis and provided with pins projecting substantially parallel to said axis, and arranged to cooperate with strips comprised in at least one vibration plate of said assembly, each said pin including an actuation surface arranged to cooperate with a complementary receiving surface on a distal end of a said corresponding strip and said distal end is placed on the same radius of said disc as said pin, wherein the section of said strips of said vibration plate gradually increases from said shortest strip which is the highest pitched, to said longest strip which is the lowest pitched, wherein said complementary receiving surface includes an end edge, which is placed, at the end of an actuation phase of said strip, on the same radius relative to said pivot axis as a complementary end edge comprised in said pin, and wherein said end edge and said complementary end edge are line segments, wherein, for said strips of the same height, and each of the given width, length and lift characteristics, the relation between said lowest pitched and longest, and said highest pitched and shortest strip, satisfies the inequality $$\frac{b_g\delta_g^2}{L_g^3} \geq \frac{b_a\delta_a^2}{3L_a^3}.$$

* * * * *